US007178189B1

(12) United States Patent
Perry et al.

(10) Patent No.: US 7,178,189 B1
(45) Date of Patent: Feb. 20, 2007

(54) MOP WITH CLAMPING ASSEMBLY

(75) Inventors: Marco Perry, Brooklyn, NY (US); Yvonne Song Lin, Brooklyn, NY (US)

(73) Assignee: Helen of Troy Limited, St. Michael (BB)

( * ) Notice: Subject to any disclaimer, the term of this patent is extended or adjusted under 35 U.S.C. 154(b) by 461 days.

(21) Appl. No.: 10/303,289

(22) Filed: Nov. 25, 2002

(51) Int. Cl.
*A47L 13/144* (2006.01)

(52) U.S. Cl. ..... 15/119.2; 15/145; 15/147.1

(58) Field of Classification Search ..... 15/119.1, 15/119.2, 145, 146, 147.1, 176.1, 176.6
See application file for complete search history.

(56) References Cited

U.S. PATENT DOCUMENTS 468,036 A * 2/1892 Loan ..... 15/146
719,383 A * 1/1903 Shych ..... 15/119.2
2,712,144 A 7/1955 Dunn
3,157,901 A 11/1964 Murphy
3,226,752 A 1/1966 Antonucci, Jr.
3,362,037 A 1/1968 Griffin
3,692,369 A 9/1972 Chase
3,704,480 A 12/1972 Whitaker
3,713,184 A 1/1973 Leland
3,727,259 A 4/1973 Wilson
3,795,934 A 3/1974 Moss
3,991,431 A 11/1976 Thielen
4,165,550 A 8/1979 Burke
4,204,295 A 5/1980 O'Connor
4,225,998 A 10/1980 Thielen
D275,294 S 8/1984 Pagano
4,481,688 A 11/1984 Graham
4,516,287 A 5/1985 Johnson et al.
4,656,686 A 4/1987 Moss et al.
4,663,796 A 5/1987 Helling et al.
4,763,377 A 8/1988 Madsen
4,766,716 A 8/1988 Dominguez
4,793,019 A 12/1988 Stima et al.
4,807,323 A 2/1989 Karpp
4,852,210 A 8/1989 Krajicek
4,908,901 A 3/1990 Torres
4,962,563 A 10/1990 Bachar
5,071,489 A 12/1991 Silvenis et al.
5,097,561 A 3/1992 Torres
5,112,156 A 5/1992 Boyer
5,167,045 A 12/1992 Rodriguez
D348,827 S 7/1994 Berti et al.
5,331,706 A 7/1994 Graham
5,361,447 A 11/1994 Ophardt
5,379,478 A 1/1995 Vosbikian
5,390,390 A 2/1995 Kresse et al.
5,419,015 A 5/1995 Garcia
5,435,852 A 7/1995 Robinson
RE35,005 E 8/1995 Torres (Continued)

FOREIGN PATENT DOCUMENTS

FR 1000046 2/1952

*Primary Examiner*—Mark Spisich
(74) *Attorney, Agent, or Firm*—Seyfarth Shaw LLP

(57) ABSTRACT

A mop is provided having a clamping assembly formed of a hinge having flanges for clamping a sponge movable into a mop head cavity in a wringing position, then to a neutral position and by depressing a release member and rotating a lever the sponge may be released from the clamping assembly.

30 Claims, 9 Drawing Sheets

U.S. PATENT DOCUMENTS

| | | | | |
|---|---|---|---|---|
| 5,442,830 | A | | 8/1995 | Ohm |
| 5,455,978 | A | | 10/1995 | Graham |
| 5,455,980 | A | | 10/1995 | Buchanan |
| 5,461,749 | A | | 10/1995 | Ahlberg et al. |
| D366,740 | S | | 1/1996 | Clausen et al. |
| 5,483,720 | A | | 1/1996 | Decoopman et al. |
| 5,528,791 | A | | 6/1996 | Wilson |
| 5,625,918 | A | | 5/1997 | Kieson et al. |
| 5,655,250 | A | | 8/1997 | Warrell |
| 5,724,696 | A | | 3/1998 | Di Giammarino |
| 5,815,878 | A | | 10/1998 | Murakami et al. |
| 5,839,147 | A | | 11/1998 | Chia-Yi et al. |
| 5,876,141 | A | | 3/1999 | Hsu |
| 5,911,258 | A | | 6/1999 | Morad |
| 6,029,308 | A | | 2/2000 | Smith |
| 6,058,548 | A | | 5/2000 | Footer et al. |
| 6,101,661 | A | | 8/2000 | Policicchio et al. |
| 6,105,193 | A | | 8/2000 | Williams et al. |
| 6,134,743 | A | * | 10/2000 | Schmidt ..... 15/236.01 |
| 6,148,465 | A | * | 11/2000 | Hsieh et al. ..... 15/118 |
| 6,237,182 | B1 | | 5/2001 | Cassar |
| 6,260,226 | B1 | | 7/2001 | Specht |

* cited by examiner

MOP WITH CLAMPING ASSEMBLY

The present invention pertains to a mop and, in particular, a mop having a clamping assembly.

BACKGROUND OF THE INVENTION

Mops having handles or levers for retracting the mop head in order to wring liquid from an absorbent mechanism, such as a sponge, attached to the mop head are well known. Such mops may include a sponge which is permanently attached to an end of the mop head, but is movable between a pair of rollers in order to compress the sponge and squeeze the liquid from the sponge. Such mops require that when the sponge is no longer able to clean properly, the entire mop including the mop head, mechanism and handle would have to be discarded. Other mops provided for disengagable sponges, for example by sliding the sponge assembly off of a bar at the end of the mop head. The removal of the sponges from such mops is difficult and requires the dirtying of the user's hands because the sponge must be grasped tightly in order to remove it from the mop head.

Therefore, there is a need for a sponge and mop head assembly which allows for the sponge to be quickly and easily removed without handling of the sponge and without requiring a great deal of physical strength.

SUMMARY OF THE INVENTION

This application discloses an embodiment which comprises a mop including an elongated handle having a bore and a mop head. A rod extends through the bore and a lever is attached to a first end of the rod and the lever pivotally attaches to the handle and is movable among a neutral position, a wringing position and a release position. A clamping assembly is attached at a second end of the rod and the clamping assembly clampingly engages a sponge and includes a hinge having a release arm. A roller is mounted to the mop head and a release member is attached to the handle so that upon activation of the release member, the lever may be moved to the release position, forcing the release arm to engage the roller in order to release the sponge from the clamping assembly. In an embodiment, the hinge may be formed by a first leaf and a second leaf and each leaf includes a proximal end having a cylindrical eye and the release arm and a distal end which includes a flange and a pin interposed between each of the cylindrical eyes of each hinge leaf. In an embodiment, the hinge may include a coil spring mounted on the pin in order to urge the clamping assembly to a closed position. In an embodiment, a pair of legs may abut each release arm from the coil spring. In an embodiment, each flange may grip a corresponding finger protruding from a top of the sponge in order to attach the sponge to the clamping assembly.

In an embodiment, a rib may run along a side of the sponge and an "L" shaped finger protrudes from the rib. In an embodiment, the rod may include an attachment head at the second end of the rod for attachment to the clamping assembly. In an embodiment, the attachment head includes a pair of cylindrically shaped couplers for receipt of the pin to attach the head to the hinge. In an embodiment, the pair of cylindrical couplers may straddle a coil spring and the couplers are centered on the pin with the cylindrical eyes of each hinge leaf located toward each end of the pin. In an embodiment, each release arm may protrude from each hinge leaf on opposing sides of the clamping assembly.

In an embodiment, each release arm may include a metal tab that extends at an angle from between 10 to 45 degrees from an axis formed transversely through the center of the clamping assembly, collinear with a longitudinal axis of the rod when the clamping assembly is in the closed position. In an embodiment, the clamping assembly may move from the closed position to an open position when the clamping assembly is moved to a position adjacent the roller so that the release arm abuts the roller in order to pivot the hinge leaves to spread the flanges apart upon movement of the lever from the neutral position to the release position. In an embodiment, upon opening of the clamping assembly, each flange of the hinge leaf may pivot away from an "L" shaped finger protruding from the sponge in order to disengage the sponge from the clamping assembly.

In an embodiment, the release member may include a spring-mounted button having a hole for receiving the rod and in a non-depressed position the button may prevent the rod from sliding therethrough. In an embodiment, the rod may include a retaining sleeve that abuts against the button in order to prevent the rod from passing therethrough. In an embodiment, the hole may be formed in a body of the button and the hole has a diameter slightly larger than the diameter of the retaining sleeve and upon depression of the button, the hole is axially aligned with the retaining sleeve so that the retaining sleeve may pass therethrough when the lever is moved towards the release position. In an embodiment, the hole includes a lead-in chamfer on a side of the body so that after release of the sponge from the clamping assembly and movement of the lever from the release position to the neutral position, the retaining sleeve engages the lead-in chamfer in order to force the button to slide back to its axially aligned position so that the retaining sleeve may slide back through the hole and back to a position where the lever is in the neutral position.

In an embodiment, the mop head may comprise a housing having a cavity for encasing the clamping assembly and for receiving the sponge therein in a retracted position. In an embodiment, the mop head may also include therein the release member mounted thereto. In an embodiment, a pair of rollers may be attached at the distal end of the mop head adjacent the cavity opening. In an embodiment, the housing may include side openings from which the sponge may protrude.

In an embodiment, the housing may include a plurality of roller retainer members at its distal end. In an embodiment, the mop head housing may include a plurality of ribs formed on an interior of the housing in order to guide the clamping assembly when it is slid in and out of the cavity. In an embodiment, the housing may include a plurality of stop abutments formed on the interior of the housing in order to stop the clamping assembly from movement within the cavity and defining the wringing position of the lever. In an embodiment, the sponge may be formed of a first half having a soft absorbent material and a second half of a semi-absorbent, durable material.

In a further embodiment, a method is provided of disengaging a sponge from a mop comprising the steps of rotating a lever attached to a rod having a clamping assembly engaging a sponge, depressing a release member so that the rod may pass therethrough, pushing the rod through a handle of the mop so that the clamping assembly engages a pair of rollers causing the clamping assembly to open and releasing the sponge from between a pair of flanges at the end of the clamping assembly in order to disengage the sponge.

BRIEF DESCRIPTION OF THE DRAWINGS

For the purpose of facilitating an understanding of the subject matter sought to be protected, there are illustrated in the accompanying drawings, embodiments thereof, from an inspection of which, when considered in connection with the following description, the subject matter sought to be protected, its construction and operation, and many of its advantages should be readily understood and appreciated.

DETAILED DESCRIPTION OF A PRESENTLY PREFERRED EMBODIMENT

Figure 1:
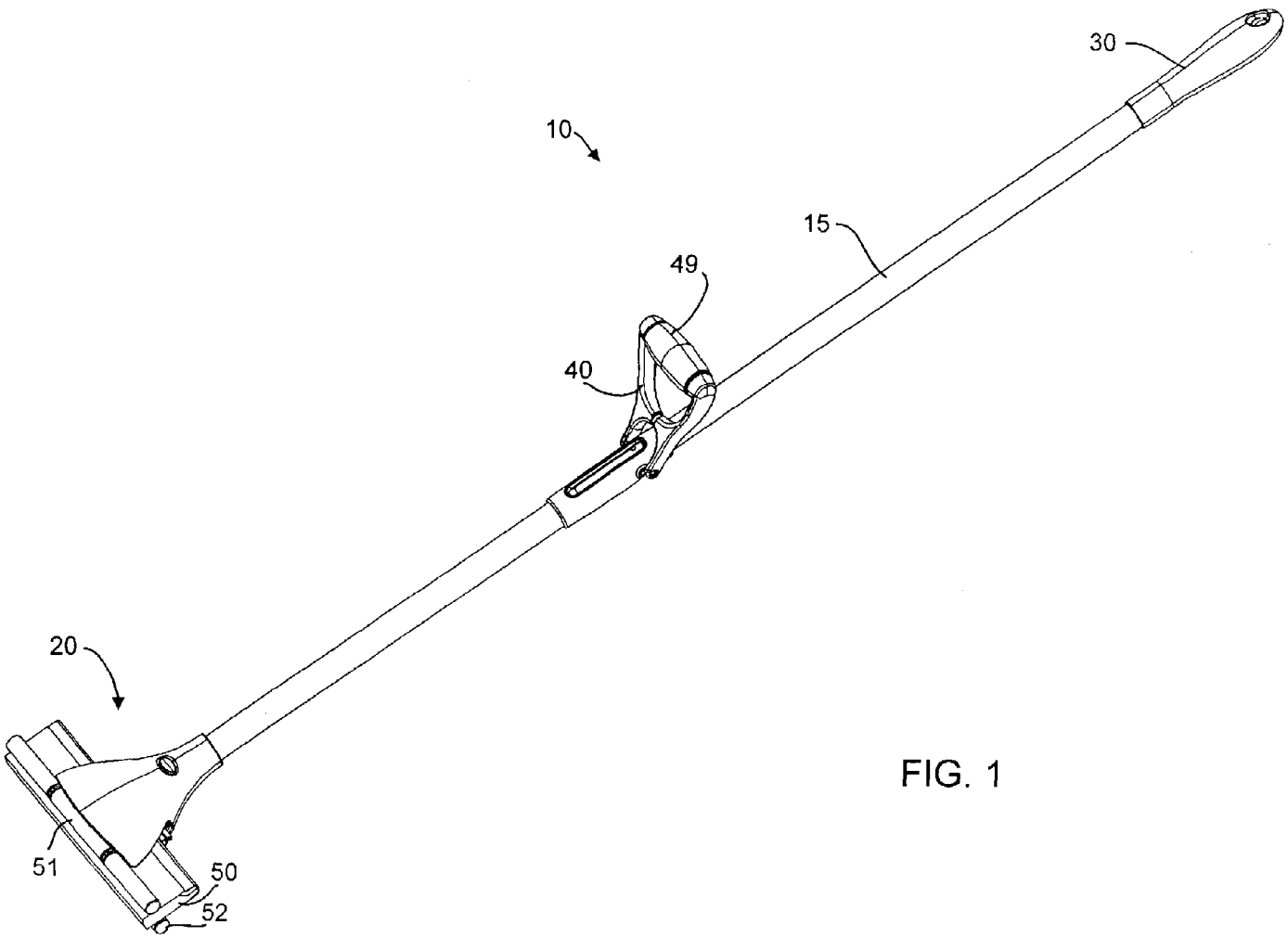
FIG. 1 is a perspective view of the mop of the present invention.
Figure 2:
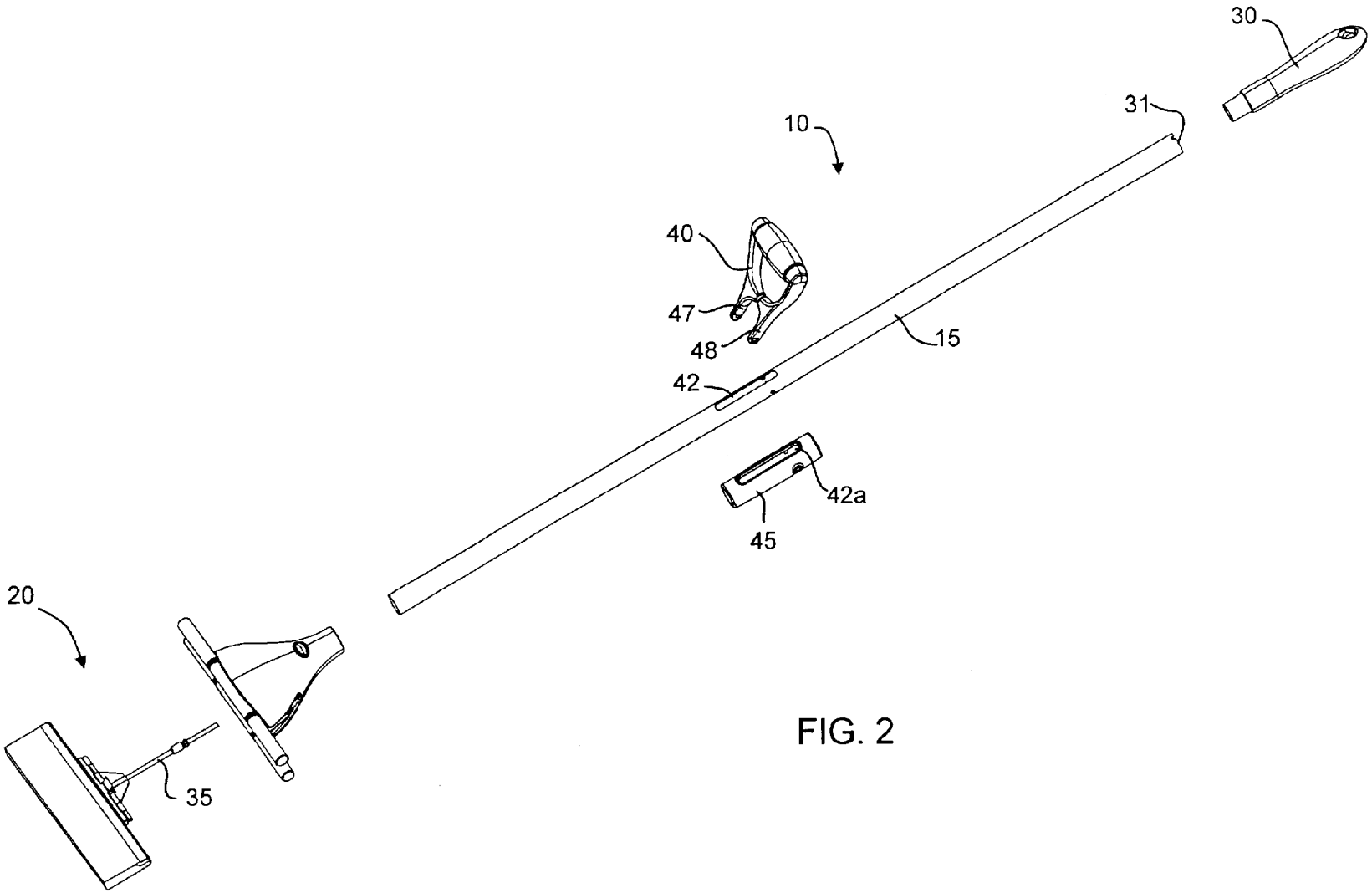
FIG. 2 is an exploded view of the mop of FIG. 1.

The invention may be understood with respect to an embodiment disclosed by FIGS. 1–9. Turning to FIGS. 1 and 2 a mop 10 is shown having a elongated handle 15. In an embodiment the handle may be formed of wood, metal, aluminum, plastic or any other rigid durable material. The handle 15 includes a mop head 20 at one end and a grip 30 at the opposite end. The handle includes an axis bore 31 formed therein and received within the bore is a rod 35 (upper portion broken away in FIG. 2). In a preferred embodiment, the rod 35 extends from the mop head 20 through the bore 31 and up through the handle 15, where it attaches to lever 40. A slit 42 is provided in the handle 15 through which a first end 16 (see FIGS. 4 and 5) of the rod 35 protrudes and attaches to the lever 40. In an embodiment, a sleeve 45 is placed around the handle 15 in order to protect the slit 42. The sleeve 45 includes a slit 42*a* which corresponds with the slit 42 formed in the handle 15. In an embodiment, the lever 40 includes a pair of arms 47,48 that pivotally attach to the handle 15. Any known fastening means may be used to attach the arms 47,48 to the handle 15. In a preferred embodiment, the arms 47, 48 are attached over the sleeve and the sleeve 45 is retained on the handle 15 via the attachment of the lever 40 therethrough. The rod 35 has a first end bent to protrude trough the slits 42, 42*a* for pivotal coupling to the lever 40.

Figure 3:
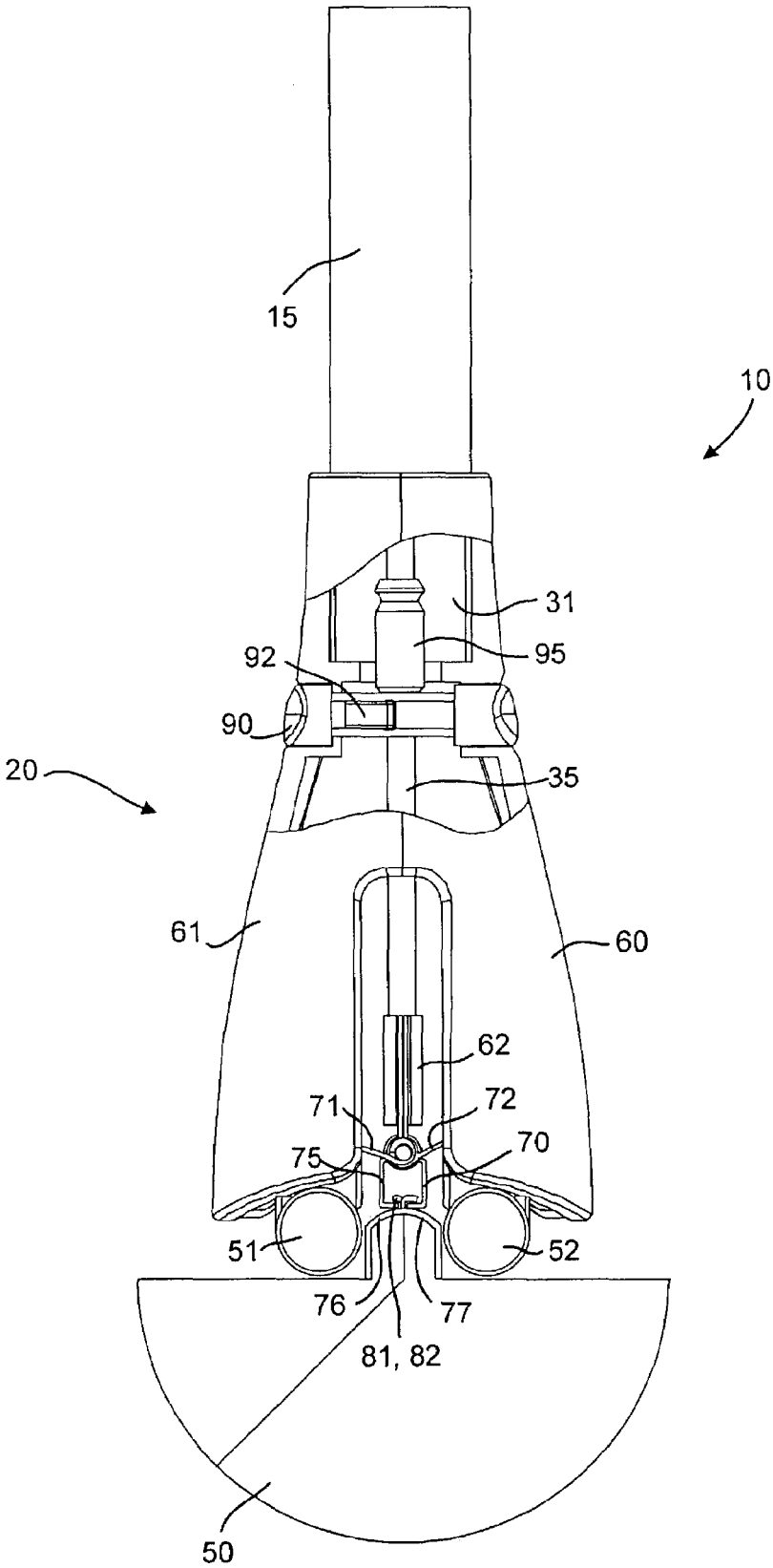
FIG. 3 is a side view of the mop head of FIG. 1 in its neutral position with portions broken away.

FIG. 1 depicts the lever 40 in its wringing position, with the lever 40 pivoted so that its gripping member 49 is disposing toward the grip 30 at the end of the handle 15. In the wringing position it can be seen that a cleaning implement, such as a sponge 50, is compressed and received between a pair of rollers 51, 52 in order to wring any moisture from the sponge 50. The lever 40 may also be moved to a neutral position where the sponge is released and decompressed (as shown in FIG. 3). The lever 40 may also be moved further to a release position (as shown in FIG. 8) where the gripping member 49 is oriented closest to the mop head 20. In an embodiment, the sponge 50 may be replaced with other cleaning implements such as absorbent sheets, towels, cleaning strips or pads.

Turning to FIG. 3, an enlarged view of the mop head 20 is depicted showing a housing 60 partially cut away to reveal the release member 90 mechanism of the mop 10. The housing 60 is attached to the handle 15 and includes rollers 51, 52 attached at the distal end 61 of the housing. Protruding from the bore 31 of the handle 15 is the rod 35. Attached at a second end 62 of the rod 35 is a clamping assembly 70. The clamping assembly includes a pair of release arms 71, 72 formed as part of a hinge 75 which includes a pair of flanges 76, 77 which clamp onto fingers 81, 82 protruding from the sponge 50. Mounted within the housing 60 is a release member or button 90 which includes a body 92 having a hole formed therein for receiving retaining sleeve 95. FIG. 3 depicts the button 90 in its non-depressed position so that the hole is not axially aligned to the rod 35, so that the retaining sleeve 95 cannot pass through the hole and the rod 35 is maintained in its neutral position. In the neutral position, the sponge 50 is maintained extended below the rollers 51, 52 in an expanded state so that the mop 10 may be used to clean surfaces such as a floor.

Figure 4:
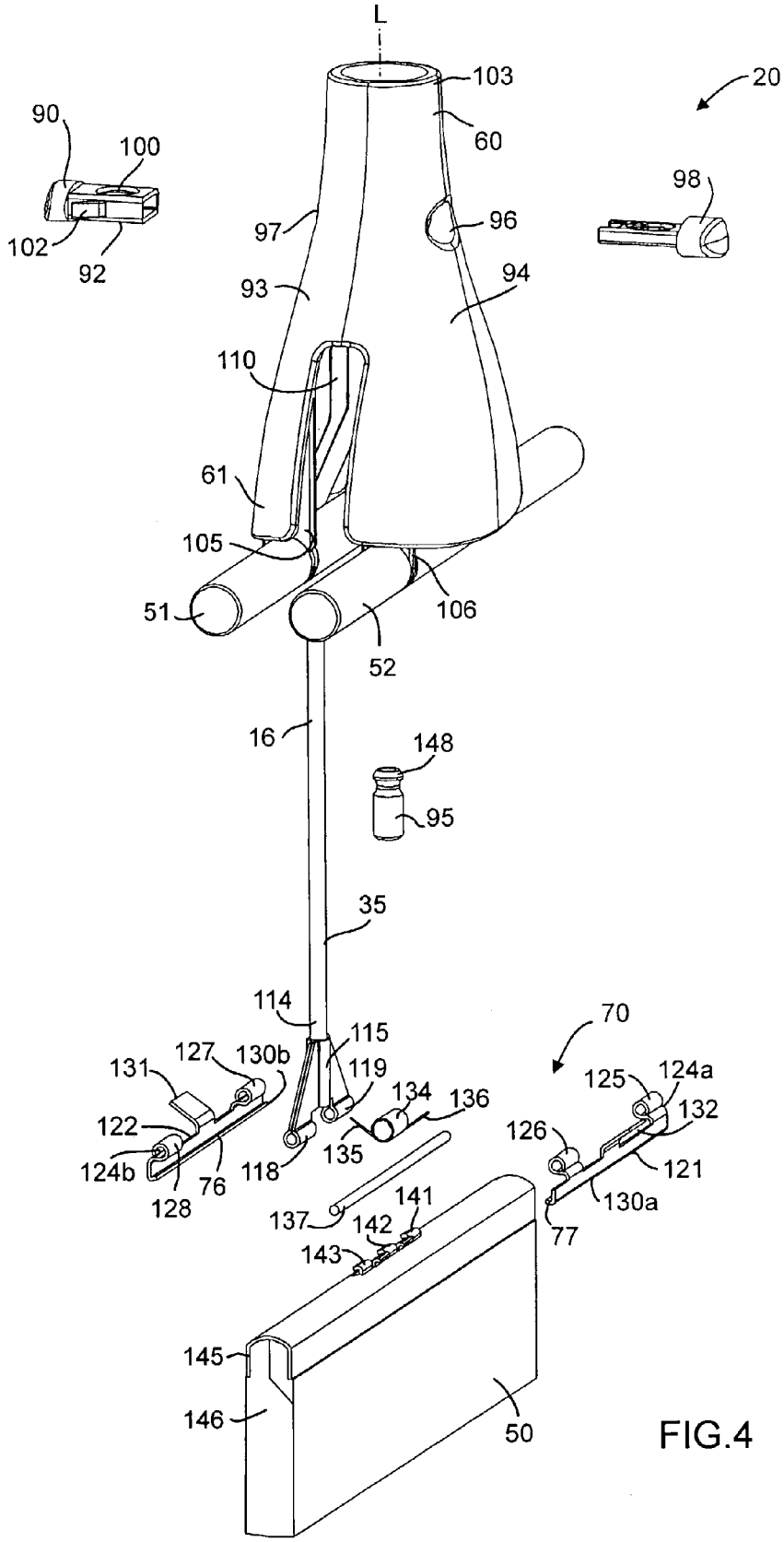
FIG. 4 is an exploded view of the mop head of FIG. 3.

FIG. 4 depicts an exploded view of the mop head 20 of the present invention. The housing 60 is formed of a first half 94 and a second half 93. Formed in each half 93, 94 is a passage 96, 97 for receiving the release button 90 and retaining button 98. The release button 90 includes a body 92 having a hole 100 formed therein and a latch arm 102. In a preferred embodiment, the release button is inserted in passage 97 and is attached to retaining button 98. The release button 90 is spring mounted to the retaining button 98 and slides on the retaining button 98 between a depressed and non-depressed position. In a preferred embodiment, the retaining button 98 is fixed within the cavity 96 and does not move and cannot be depressed. The housing 60 includes neck 103 having longitudinal axis L. The release button 90 slides between a depressed position where the center of the hole 100 is aligned with the longitudinal axis L and a non-depressed position where the hole 100 is offset from the longitudinal axis L. Latch arms 102 help to retain the release button 90 in the non-depressed position.

The distal end 61 of the housing 60 includes rollers 51, 52 attached thereto by attachment members 105, 106. The housing 60 forms a cavity 110 for receiving the clamping assembly 70 and sponge 50 therein. Also mounted within the housing 60 is rod 35 along the longitudinal axis L. The first end 16 of the rod 35 protrudes through the neck 103 to which the handle 15 is attached. The rod 35 protrudes up through the handle 15 and attaches to the lever 40. The second end 114 of the rod 35 includes an attachment head 115. The attachment head 115 includes a pair of cylindrical couplers 118, 119 in order to attach the rod 35 to the clamping assembly 70.

The clamping assembly 70 consists of a hinge formed of a first leaf 121 and a second leaf 122. Each leaf 121, 122 includes a proximal end 124*a*, 124*b* having a pair of cylindrical eyes 125, 126, 127, 128. Also on the proximal end 124*a*, 124*b* is a release arm 131, 132. Each distal end 130*a*, 130*b* includes a flange 76, 77. In an embodiment, the hinge is made of metal and each release arm 131, 132 is a metal tab angled from between 10 to 45 degrees from an axis formed transversely through the center of the clamping assembly collinear with a longitudinal axis of the rod when the clamping assembly is in a closed position. A coil spring 134 is situated in the gap between the cylindrical couplers 118, 119 of the attachment head 115. The coil spring 134 includes a pair of legs 135, 136 that urge the hinge to a closed position. The attachment head 115 is assembled to the clamping assembly 70 by inserting pin 137 through the cylindrical eye 128 of the second leaf 122, then through the cylindrical eye 126 of first leaf 121, then through the coupler 118, then through coil spring 134, then through the coupler 119, then through the cylindrical eye 127 and finally through the cylindrical eye 125 of first leaf 121. The pivotal hinge is formed which provides for a clamping assembly 70 in order to clamp onto L-shaped fingers 141, 142, 143 protruding from a rib 145 formed at a top 146 of the sponge 50. The clamping assembly 70 operation will be explained in more detail below and includes an annular recess 148 for engaging an annular protrusion 155 protruding from within the hole 100 of the release button 90.

Figure 5:
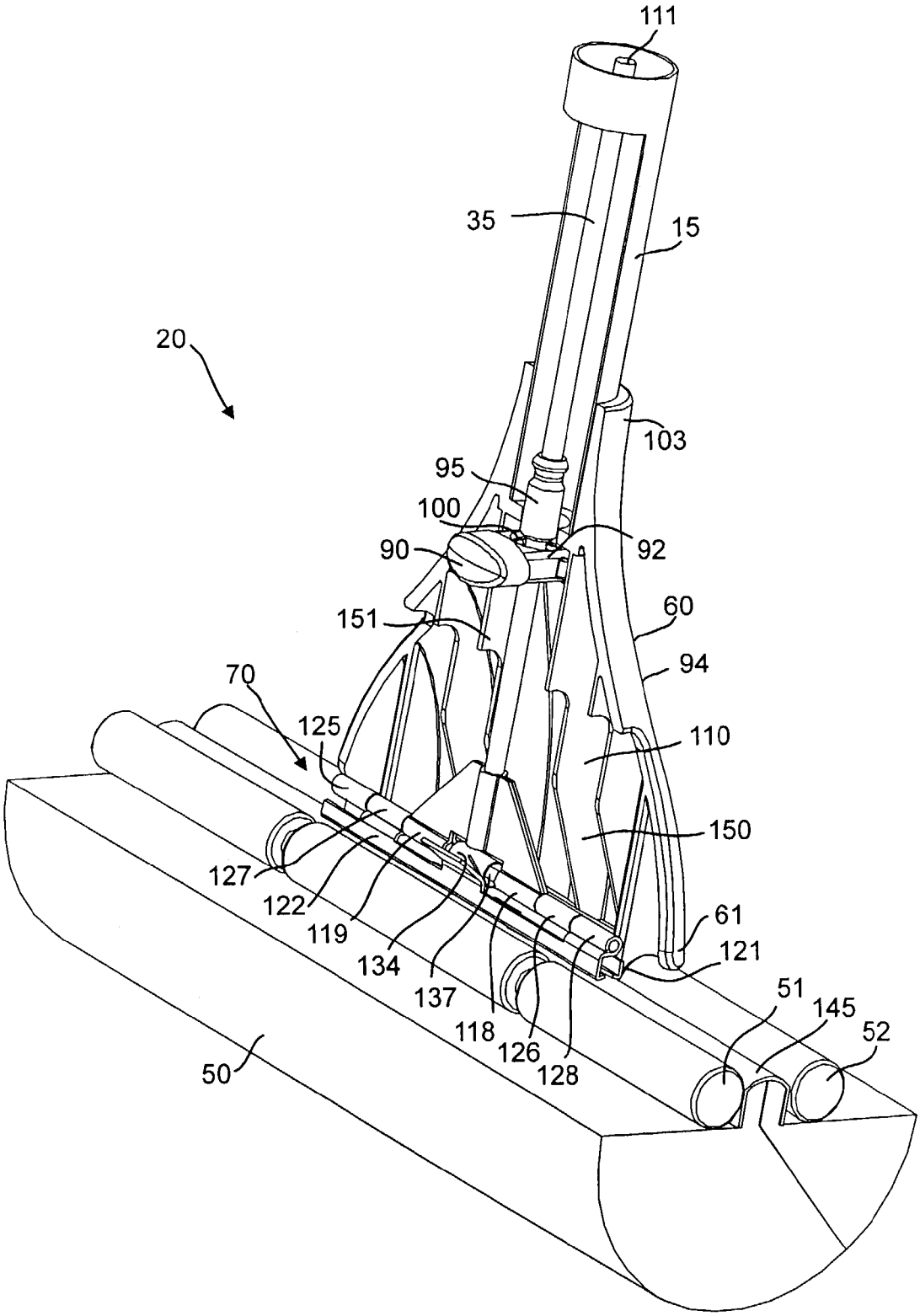
FIG. 5 is an enlarged perspective view of the mop head of FIG. 3, partially disassembled.

A retaining sleeve 95 is assembled onto the rod 35 and includes an annular recess 148 for engaging an annular protrusion 155 protruding from within the hole 100 of the release button 90. As shown in FIG. 5, the retaining sleeve 95 is mounted so that when the rod 35 is in a neutral position with the sponge 50 oriented below the rollers 51, 52 in an expanded position, the retaining sleeve 95 is oriented above and abuts the side of the body 92 of the release button 90 adjacent the hole 100. FIG. 5 depicts the mop head 20 in a partially unassembled form having the first half 94 of housing 60 assembled with the handle 15. However, second half 93 of the housing 60 has been removed to expose the inner mechanism of the mop head 20. In the neutral position, where the sponge 50 is extended for cleaning surfaces such as a floor, the release button 90 is in a non-depressed position and the hole 100 is not axially aligned with the longitudinal axis L or the rod 35 and therefore retaining sleeve 95 cannot slide therethrough and is abutting against the side of the body 92 of the button 90 in order to keep the rod 35 and lever 40 from moving to the release position.

Figure 6:
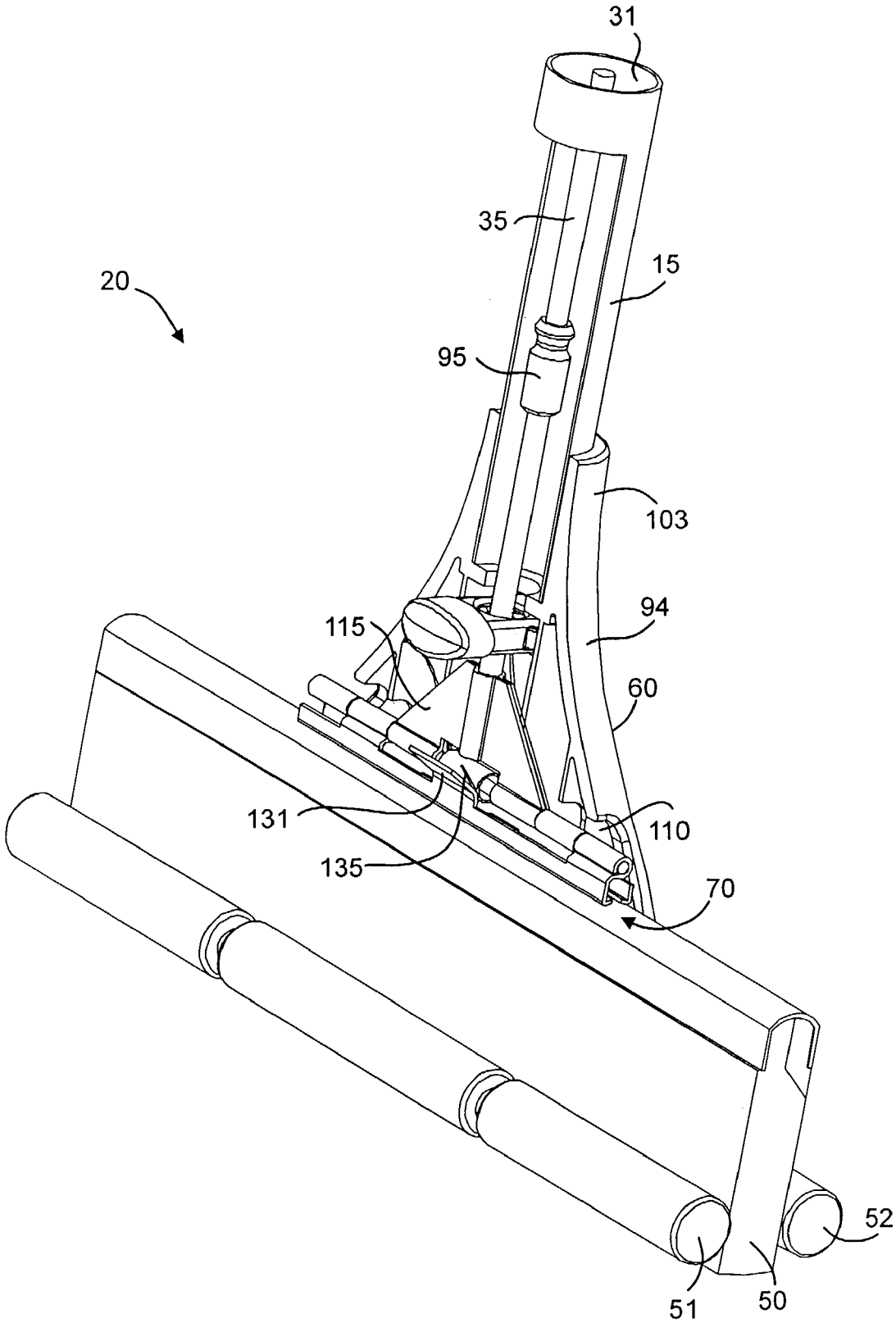
FIG. 6 is a view similar to FIG. 5 showing the mop head in its retracted wringing position.

In the neutral position the clamping assembly 70 is located within the cavity 110 near the distal end 61 of the housing 60. The first half 94 includes a plurality of ribs 150 that protrude into the cavity 110 but include shaped or tapered edges in order to guide the clamping assembly as it is moved through the cavity 110. The ribs 150 also form stop abutments 151 in order to limit the upward movement of the clamping assembly 70 and the rod 35. The stop abutment 151 abuts the clamping assembly 70 as the sponge is moved to its wringing position (FIG. 6). The clamping assembly 70 is depicted in FIG. 5 in its assembled state having the hinge formed of first leaf 121 attached to second leaf 122 hinged about pin 137 having cylindrical eyes 125, 126, 127, 128 mounted on the terminal ends of the pin 135 and the cylindrical couplers 118, 119 of the attachment head 115 of the rod 35 straddling a coil spring 134 at the center of the pin 135. The clamping assembly 70 is clamped to the rib 145 of the sponge 50.

Turning to FIGS. 6, 7, 8 and 8*a*, the operation of the mop will be explained in sequence from the wringing position (FIG. 6) to the neutral position (FIG. 7) and the release position (FIG. 8). FIG. 6 discloses the mop head 20 in the wringing position having the sponge 50 in a compressed state between the rollers 51, 52. The lever 40 is moved to a position where the gripping member 49 is closest to the grip 30 at the end of the handle 15. In this position, the rod 35 is pulled upward through the bore 31 of the handle 15 so that the retaining sleeve 95 is moved away from the neck 103 of the housing 60. In turn, the attachment head 115 of the rod 35 pulls the clamping member 70 upward into the cavity 110 of the housing 60. The flanges 76, 77 clamp onto the "L" shaped fingers 141, 142, 143 of the sponge 50. In an embodiment, the flanges 76, 77 are bent at an acute angle so that when they engage the fingers 141, 142, 143 the clamping force against the fingers 141, 142, 143 increases as the clamping assembly 70 is moved further into the cavity 110. In another embodiment, the fingers 141, 142, 143 may also be bent at an acute angle so that when they engage the flanges 76, 77, the sponge 50 cannot easily disengage from the clamping assembly 70 because the flanges 76, 77 and fingers 141, 142, 143 must separate vertically a distance so that the flanges 76, 77 can open and separate horizontally and pivot on the hinge to the open position and release the sponge 50 (FIG. 8). In an embodiment the flanges 76, 77 are bent at approximately 80° from each of the leaves 121, 122 and the fingers 141, 142, 143 are bent at approximately 80° from the longitudinal axis L of the rod 35. With the fingers 141, 142, 143 engaging the flanges 76, 77 the clamping assembly 70 pulls the sponge 50 through the rollers 51, 52 and compresses the sponge therebetween in order to squeeze moisture from the sponge. In an embodiment, three separate rollers are provided on each side of the housing 60. The sponge 50 is received within the cavity 110 with its two ends protruding through side openings of the housing 60.

Figure 7:
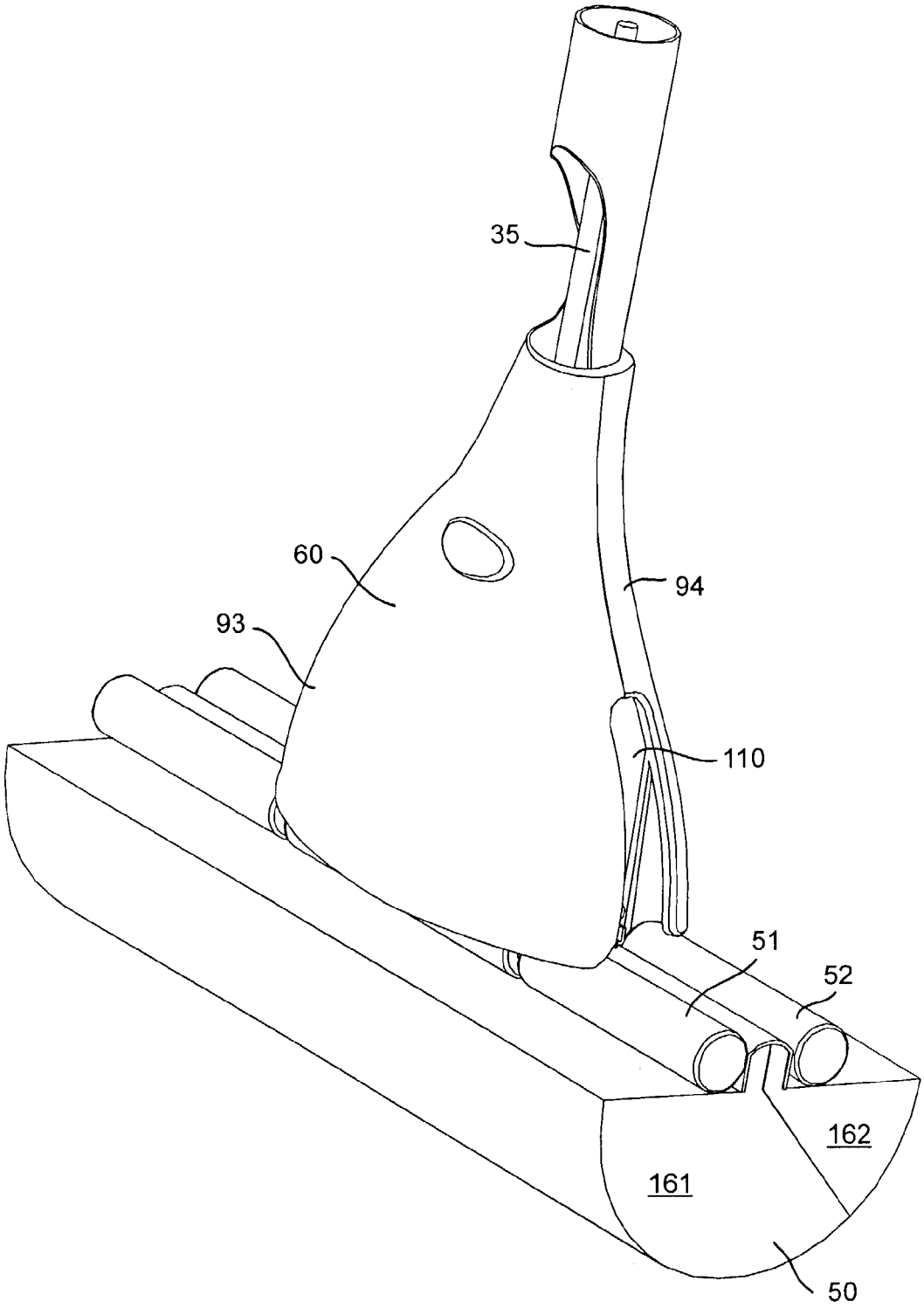
FIG. 7 is a perspective view of the mop head of FIG. 3.

When the lever 40 is pivoted away from the grip 30 at the end of the handle 15 from the wringing position to the neutral position, the sponge 50 expands as shown in FIG. 7. By moving the lever 40 and, in turn, the rod 35 downward, it pushes the clamping assembly 70 and sponge 50 out from the cavity 110 of the housing 60. This neutral position is the preferred at rest position of the mop, in that most of the work accomplished with the mop will be done in this position with the sponge 50 frilly retracted with a large cleaning surface exposed. The mop is maintained in this neutral position by the retaining sleeve 95 abutting the body 92 of the release button 90 (FIG. 5). This arrangement keeps the rod 35 from slipping downward and restricting the clamping assembly from moving lower within the cavity 110 of the housing 60. The rod is restricted from moving upward by the resistance of the rollers 51, 52 against the sides of the mop 50. In a preferred embodiment, the mop 50 performs dual cleaning functions via a first portion 161 formed of a durable material such as urethane and a second portion 162 formed of a highly absorbent material such as cellulose. This dual function sponge 50 provides for efficient cleaning and long life of the sponge by allowing for the first portion 161 to be used for scrubbing of dirty areas and the second portion 162 to absorb liquid.

Figures 9, 10:
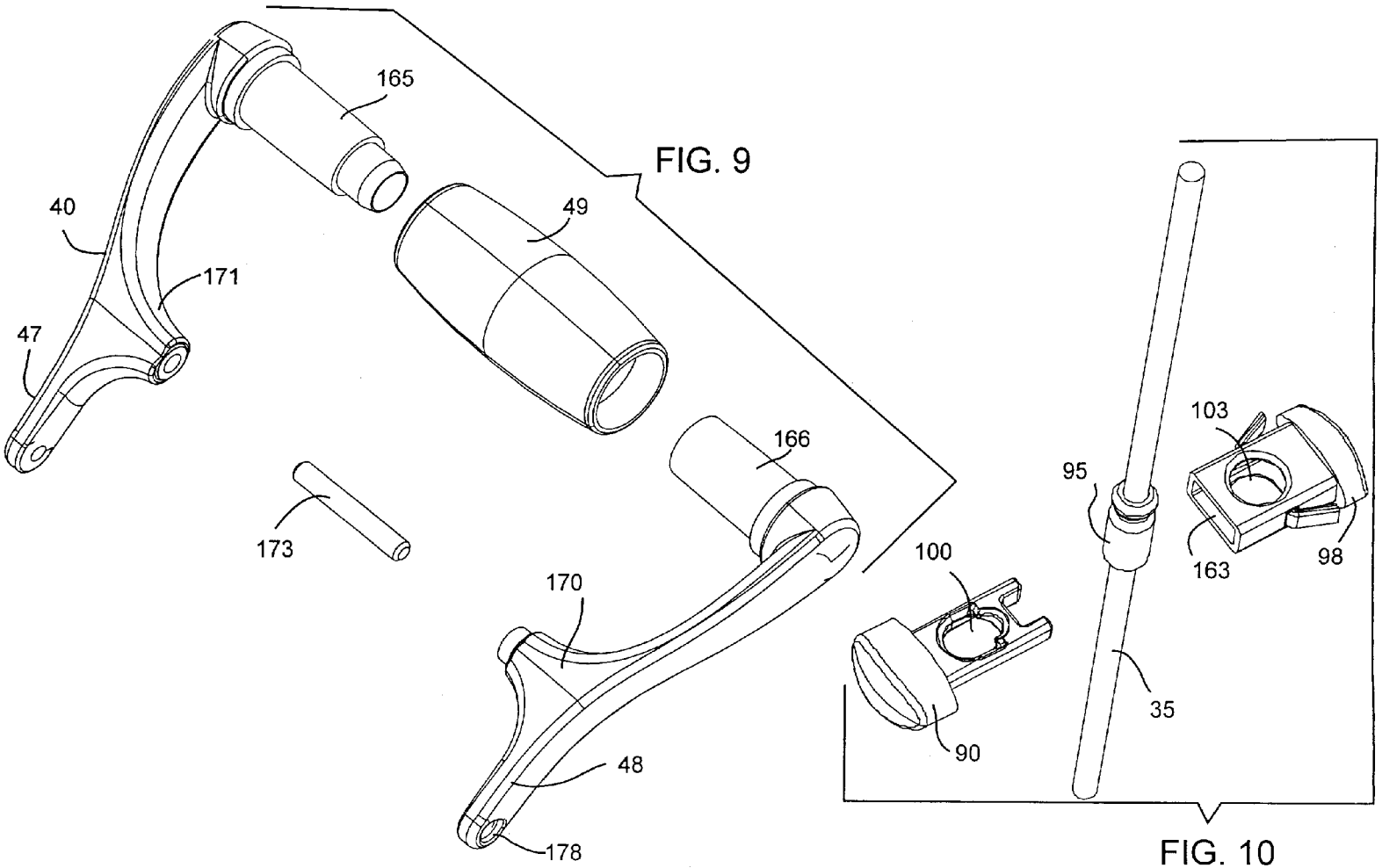
FIG. 9 is an enlarged, exploded perspective view of the lever of the mop of FIG. 1.
FIG. 10 is an exploded perspective view of the release member and rod of the present invention.

The sponge 50 may be released from the mop head 20 as shown in FIG. 8 and FIG. 10, by depressing release button 90 so that the hole 100 of the release button 90 is axially aligned with a hole 103 in the retaining button 98, the retaining sleeve 95 and also the longitudinal axis L. By depressing the button 90, the retaining sleeve 95 may slide through the hole 100 of the release button 90 allowing the rod 35 to slide downward through the bore 31 of the handle 15. In an alternate embodiment, the sleeve 95 may be a ring or other shaped member. The release button 90 spring mounted within the rectangular aperture 163 of the retaining button and the rod 35 is inserted through the holes 100,103. The key-shaped hole 100 of the release button 90 must be depressed so that the large portion of the hole 100 is aligned with hole 103 so that the sleeve 95 may pass therethrough Therefore, it may be understood that while one hand is gripping the housing 61 and depressing release button 90, the other hand of the operator is grasping the lever 40 and rotating it toward the mop head 20. The rod 35 moves downward so that the attachment head 115 pushes the clamping assembly 70 downward in a position between the rollers 51, 52 so that the release arms 131, 132 abut the edges of the rollers 51, 52 and cause the hinge to pivot in order to spread the distal end 61 and flanges 76, 77 apart and release the L-shaped fingers 141–143 and the sponge 50. Therefore, it may be understood that the lever 40, release member 90, clamping assembly 70 and rollers 51, 52 combine to form a position adjustment assembly of the mop and without having to touch the sponge 50 with a hand, the sponge 50 may be released from the mop head 20 by depression of the release button 90 and pivoting the lever 40.

In an embodiment, the release button 90 may include a safety release so that when the lever 40 is depressed with a large force and the retaining sleeve 95 is forced against the body 92 without depressing the release button 90 the retaining sleeve 95 abuts against a chamfered notch on the body 92 of the button 90 in order to engage the button body 92 and cause the button 90 to move to its depressed position with the hole 100 aligned with the longitudinal axis L so that the retaining sleeve 95 may slide through.

Figure 8A:
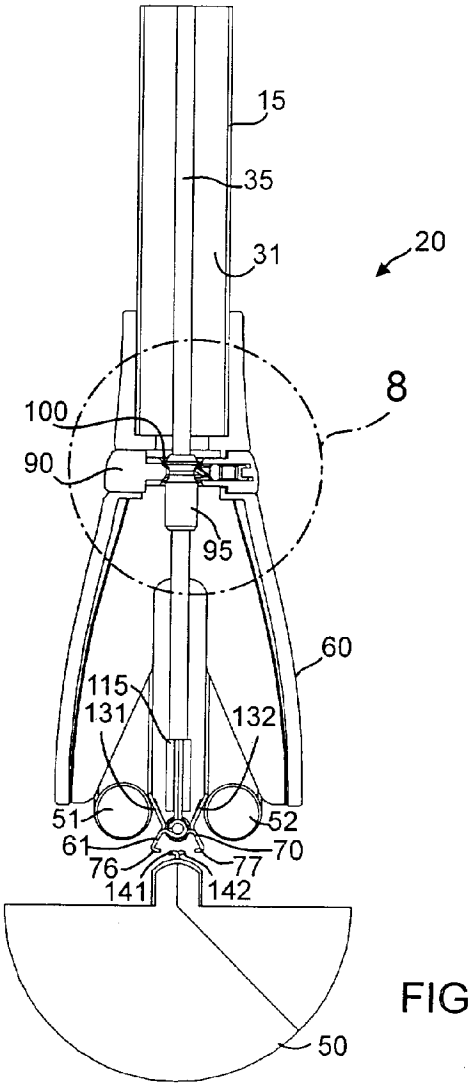
FIG. 8*a* is an enlarged, fragmentary view in partial sections of a portion of the mop head of FIG. 8 designated by the circle 8*a;*
Figure 8:
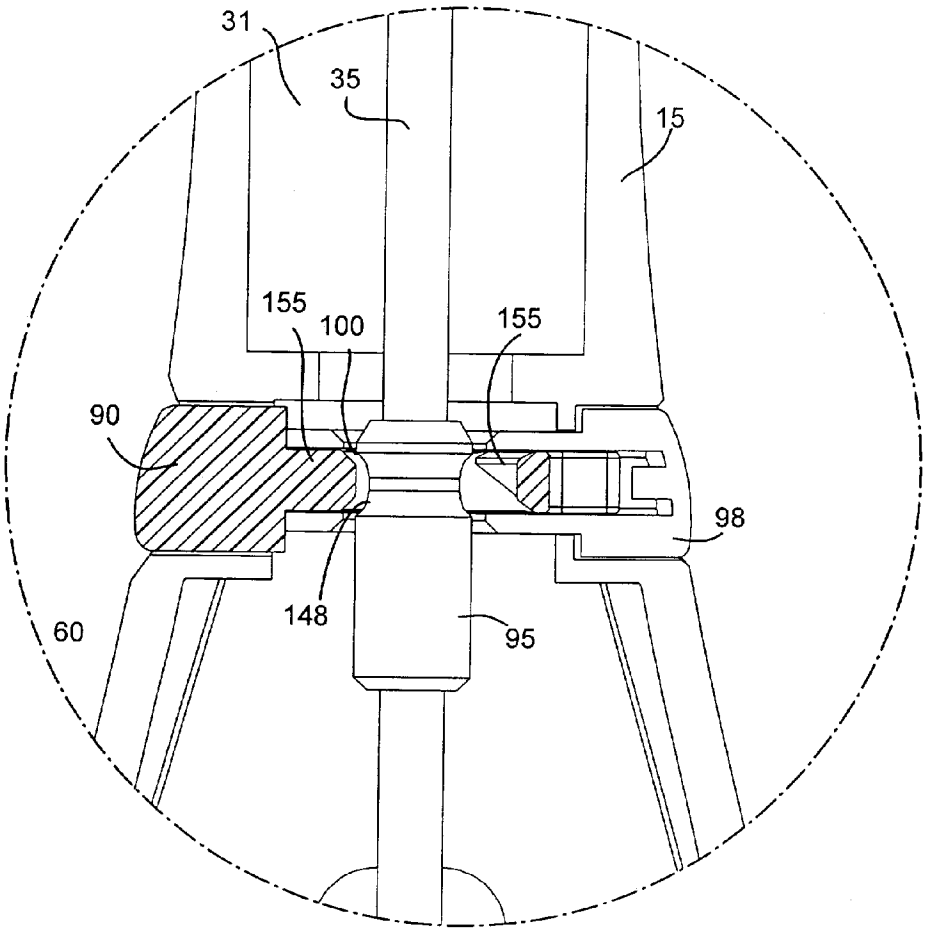
FIG. 8 is a side elevation view of the mop head of FIG. 3 shown in its released position.

After the clamping assembly 70 is opened and the old sponge 50 is removed, the clamping assembly 70 is maintained in its open position by locking the clamping assembly between the rollers 51, 52 via the retaining sleeve 94 annular recess 148 abutting the annular protrusion 155 within the hole 100 of the release button 90 (FIG. 8*a*). The release button 90 is spring mounted to the retaining button 98 so that it is biased to the non-depressed position and the annular protrusion engages the annular recess 148 to hold the retaining sleeve 95 and rod 35 in the release position while a new sponge can be inserted between the flanges 76, 77 of the clamping assembly 70. Once a new sponge is attached to the clamping assembly 70 the release button 90 is fully depressed in order to disengage the annular protrusion 155 from the annular recess 148 so that the retaining sleeve 95 can be removed from within the hole 100 of the release button 90. The lever 40 is rotated from the wringing position, after a new sponge is attached to the clamping assembly 70, to the neutral position. The retaining sleeve 95 passes through the hole 100 of the release button 95 so that the rod 35, sponge 50 and lever 40 may return to the neutral position.

FIG. 9 discloses a exploded perspective view of the lever 40 showing the gripping member 49 rotatably mounted between a pair of spindles 165, 166. Arms 47, 48 include support member 170, 171 having a pin 173 mounted therein to support the two members. Each arm 47, 48 includes an aperture 178 for receiving a fastener in order to attach the lever 40 to the handle 15. A portion of the pin 173 is exposed after assembly within support members 170, 171 and a hook is mounted thereto that is formed at the end of the rod 35. The pin 173 can rotate upon pivoting of the lever 40 pulling or pushing the rod 35.

The matter set forth in the foregoing description and accompanying drawings is offered by way of illustration only and not as a limitation. While particular embodiments have been shown and described, it will be obvious to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A mop comprising:

an elongated handle;

a rod carried by the handle for movement relative thereto;

a lever attached to a first end of the rod and pivotally attached to the handle and being movable among a neutral position, a wringing position and a release position for effecting corresponding movements of the rod;

a clamping assembly attached at a second end of the rod;

a cleaning implement clampingly engaged by the clamping assembly; and a release member attached to the handle so that upon activation of the release member, the lever may be moved to the release position to activate the clamping assembly to an open condition to actuate the clamping assembly in order to release the cleaning implement from the rod.

2. The mop of claim 1 wherein the clamping assembly includes a hinge having a release arm and a roller mounted to the handle adjacent the second end of the rod so that the release arm engages the roller in order to expand the hinge and release the cleaning implement from the clamping assembly.

3. The mop of claim 2 wherein the hinge is formed by a first leaf and second leaf and each leaf includes a proximal end having a cylindrical eye and the release arm and a distal end having a flange; and a pin interposed between each of the cylindrical eyes of each hinge leaf.

4. The mop of claim 3 wherein the hinge includes a coil spring mounted on the pin in order to urge the clamping assembly to a closed position.

5. The mop of claim 4 wherein the coil spring includes a pair of legs respectively abutting the release arms.

6. The mop of claim 5 wherein the cleaning implement is a sponge and includes fingers protruding from a top of the sponge and each flange grips one of the fingers in order to attach the sponge to the clamping assembly.

7. The mop of claim 6 wherein the sponge includes a rib running along a side of the sponge and an "L" shaped finger protruding from the rib.

8. The mop of claim 3 wherein the rod includes an attachment head at the second end of the rod for attachment to the clamping assembly.

9. The mop of claim 8 wherein the attachment head includes a pair of cylindrically shaped couplers for receipt of the pin to attach the head to the hinge.

10. The mop of claim 9 wherein the couplers straddle a coil spring and the couplers are centered on the pin with the cylindrical eyes of each hinge leaf located toward each end of the pin.

11. The mop of claim 10 wherein the release arms respectively protrude from the hinge leaves on opposing sides of the clamping assembly.

12. The mop of claim 11 wherein each release arm is a metal tab that extends at an angle in the range of about 10 degrees to about 45 degrees from a longitudinal axis of the rod when the clamping assembly is in a closed position.

13. The mop of claim 12, wherein the clamping assembly moves from the closed position to an open position when the clamping assembly is moved to a position adjacent the roller so that the release arm abuts the roller in order to pivot the hinge leaves to spread the flanges apart upon movement of the lever from the neutral position to the release position.

14. The mop of claim 13 wherein the clamping assembly includes fingers that are substantially "L" shaped and upon opening of the clamping assembly, each flange of the hinge leaf pivots away from each "L" shaped finger protruding from the cleaning implement in order to disengage the cleaning implement from the clamping assembly.

15. The mop of claim 1 wherein the release member includes a spring biased button having a hole for receiving the rod therethrough and shaped so that in a non-depressed position the button prevents the rod from sliding therethrough.

16. The mop of claim 15, wherein the rod includes a retaining sleeve that abuts against the button in order to limit movement of the rod therethrough.

17. The mop of claim 16 wherein the hole is formed in a body of the button and the hole has a portion slightly larger than the diameter of the retaining sleeve and upon depression of the button, the hole is axially aligned with the retaining sleeve so that the retaining sleeve may pass therethrough when the lever is moved toward the release position.

18. The mop of claim 17 wherein the hole includes a lead-in chamfer on a side of the body so that after release of the cleaning implement from the clamping assembly and movement of the lever from the release position to the neutral position, the retaining sleeve engages the lead-in chamfer in order to force the button to slide back to its axially aligned position so that the retaining sleeve may slide back through the hole and back to a position where the lever is in the neutral position.

19. The mop of claim 1 wherein the handle includes a mop head comprising a housing having a cavity for encasing the clamping assembly and for receiving the cleaning implement therein in a retracted position.

20. The mop of claim 19 wherein the mop head also includes therein the release member mounted thereto.

21. The mop of claim 20 wherein the mop head includes a first roller and second roller, the rollers being attached at a distal end of the mop head adjacent the cavity opening.

22. The mop of claim 20 wherein the housing includes side openings from which the cleaning implement may protrude.

23. The mop of claim 20 wherein the housing includes a plurality of roller retainer members at its distal end.

24. The mop of claim 20 wherein the mop head housing includes a plurality of interior ribs formed in the cavity of the housing in order to guide the clamping assembly when it is slid in and out of the cavity.

25. The mop of claim 20 wherein the housing includes a neck and a plurality of stop abutments formed in the cavity of the housing in order to stop the clamping assembly from movement within the cavity toward the neck in the wringing position.

26. The mop of claim 1 wherein the cleaning implement includes a sponge that is formed of a first portion having a soft absorbent material and a second portion of a semi-absorbent, durable material.

27. A mop comprising:

an elongated handle;

a rod carried by the handle for movement relative thereto;

a lever attached to a first end of the rod and pivotally attached to the handle and being movable among a neutral position, a wringing position and a release position for effecting corresponding movements of the rod;

a clamping assembly attached at a second end of the rod;

a cleaning implement clampingly engaged by the clamping assembly; and a release member attached to the handle so that upon activation of the release member, the lever may be moved to the release position to activate the clamping assembly to an open condition to release the cleaning implement; and the clamping assembly including a hinge having a release arm and a roller mounted to the handle adjacent the second end of the rod so that the release arm engages the roller in order to expand the hinge and release the cleaning implement from the clamping assembly.

28. A mop comprising:

an elongated handle;

a rod carried by the handle for movement relative thereto;

a lever attached to a first end of the rod and pivotally attached to the handle and being movable among a neutral position, a wringing position and a release position for effecting corresponding movements of the rod;

a clamping assembly attached at a second end of the rod;

a cleaning implement clampingly engaged by the clamping assembly; and a release member attached to the handle so that upon activation of the release member, the lever may be moved to the release position to activate the clamping assembly to an open condition to release the cleaning implement, the release member including a spring biased button having a hole for receiving the rod therethrough and shaped so that in a non-depressed position the button prevents the rod from sliding therethrough.

29. A mop comprising:

an elongated handle;

a rod carried by the handle for movement relative thereto;

a lever attached to a first end of the rod and pivotally attached to the handle and being movable among a neutral position, a wringing position and a release position for effecting corresponding movements of the rod;

a clamping assembly attached at a second end of the rod;

a cleaning implement clampingly engaged by the clamping assembly; and a release member attached to the handle so that upon activation of the release member, the lever may be moved to the release position to activate the clamping assembly to an open condition to release the cleaning implement; and the handle includes a mop head including a housing having a cavity for encasing the clamping assembly and for receiving the cleaning implement therein in a retracted position, the mop head having therein the release member mounted thereto.

30. A cleaning tool comprising:

an elongated handle having a bore;

a rod disposed in the bore for longitudinal movement relative thereto;

a lever attached to a first end of the rod and the lever pivotally attached to the handle;

a cleaning implement attached to a second end of the rod;

a release member attached to the handle engaging the rod in order to control the longitudinal movement so that the cleaning implement may be released from the rod;

rollers attached to the cleaning tool, the cleaning implement including a sponge that upon pivoting of the lever moves between the rollers to a wringing position where the sponge is compacted in order to squeeze liquid therefrom, the release member allows the rod to move between the wringing position, a neutral position and a release position so that in the neutral position the sponge is adjacent the rollers and expanded to allow for cleaning; and a clamping assembly including a hinge having a release arm and in the neutral position the clamping assembly is in a closed position adjacent the rollers, opposed to the sponge.

* * * * *